US006851979B2

(12) United States Patent
Yen

(10) Patent No.: US 6,851,979 B2
(45) Date of Patent: Feb. 8, 2005

(54) ELECTRIC CONNECTOR

(75) Inventor: Wu Bin Yen, Taipei Hsien (TW)

(73) Assignee: Chuan Yi Precision Industry Co., Ltd., Taipei Hsien (TW)

( * ) Notice: Subject to any disclaimer, the term of this patent is extended or adjusted under 35 U.S.C. 154(b) by 24 days.

(21) Appl. No.: 10/394,232

(22) Filed: Mar. 24, 2003

(65) Prior Publication Data

US 2004/0192110 A1 Sep. 30, 2004

(51) Int. Cl.[7] ..... H01R 13/648
(52) U.S. Cl. ..... 439/607
(58) Field of Search ..... 439/607–610, 439/101

(56) References Cited

U.S. PATENT DOCUMENTS 4,889,502 A * 12/1989 Althouse et al. ..... 439/607
6,146,201 A * 11/2000 Chen ..... 439/607
6,257,929 B1 * 7/2001 Wang ..... 439/607

* cited by examiner

*Primary Examiner*—Javaid H. Nasri
(74) *Attorney, Agent, or Firm*—Rosenberg, Klein & Lee

(57) ABSTRACT

An electric connector formed of a housing, a set of terminals and a metal shield is disclosed, in which the terminals each have a hooked portion forced into engagement with the inside wall of the corresponding terminal slot in the housing, and the housing has a hook hooked in a respective hook hole of the metal shield to secure the metal shield in position.

1 Claim, 11 Drawing Sheets

ELECTRIC CONNECTOR

BACKGROUND OF THE INVENTION

1. Field of the Invention

The present invention relates to electric connectors and, more particularly, to such an electric connector, which has the parts thereof positively fastened to one another and, which has grounding and metal shield means to protect against electromagnetic interference.

2. Description of the Related Art

A variety of electric connectors have been developed for use in computers, computer peripheral apparatus, PDAs (personal digital assistants), Cell phones, and any of a variety of mobile electronic apparatus. An electric connector for this purpose generally comprises an electrically insulative housing holding a set of terminals and a metal shield fastened to the outside of the housing for EMI protection. According to conventional designs, the metal shield may vibrate or be forced out of the housing accidentally after a long use of the electric connector.

SUMMARY OF THE INVENTION

The present invention has been accomplished under the circumstances in view. It is one object of the present invention to provide an electric connector, which has the parts thereof positively fastened to one another against vibration. It is another object of the present invention to provide an electric connector, which has grounding and metal shield means to protect against electromagnetic interference.

According to the present invention, the electric connector comprises a housing, the housing having two parallel rows of terminal slots; a plurality of terminals respectively mounted in the terminal slots of the housing; and a metal shield mounted outside the housing for EMI (Electromagnetic interference) protection; wherein the terminals each have a hooked portion forced into engagement with an inside wall of the corresponding terminal slot in the housing; the housing comprises at least one hook adapted to secure the metal shield; the metal shield comprises at least one hook hole adapted to receive the at least one hook of the housing respectively.

DETAILED DESCRIPTION OF THE PREFERRED EMBODIMENT

Figure 1A:
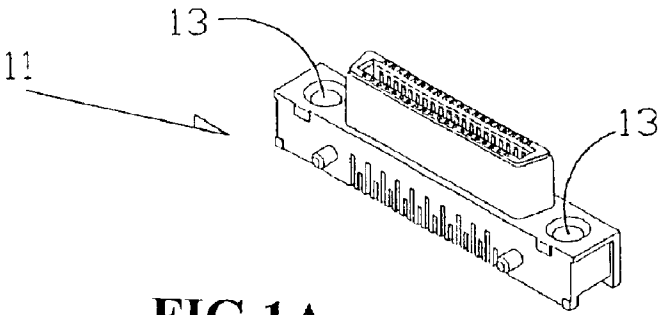
FIGS. 1A~1C are elevational views of a housing for electric connector obtained from different angles according to the present invention.
Figure 1B:
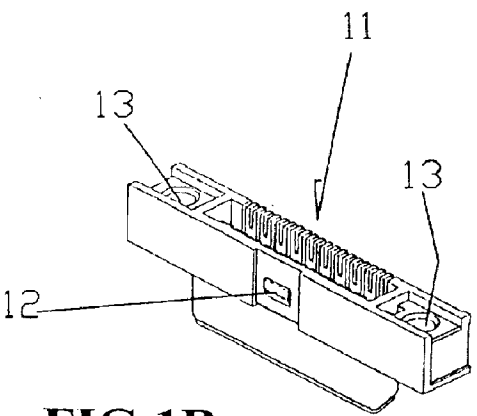
Figure 1C:
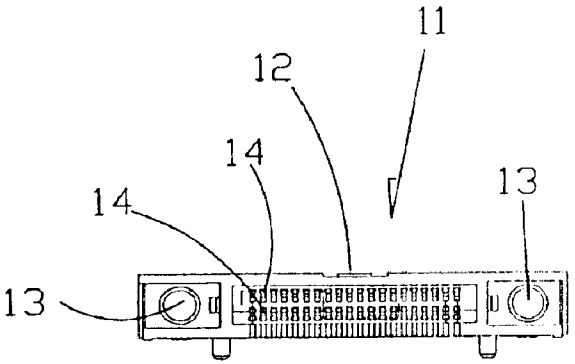
Figure 1D:
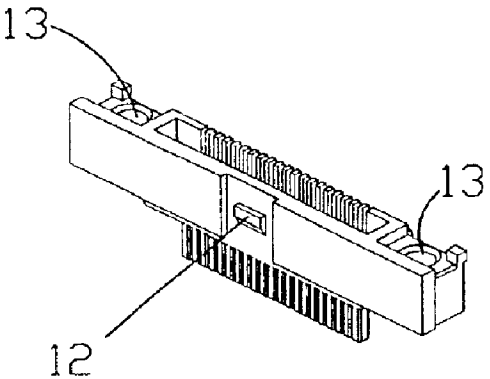
FIGS. 1D~1F are elevational views of an alternate form of the housing for electric connector obtained from different angles according to the present invention.
Figure 1E:
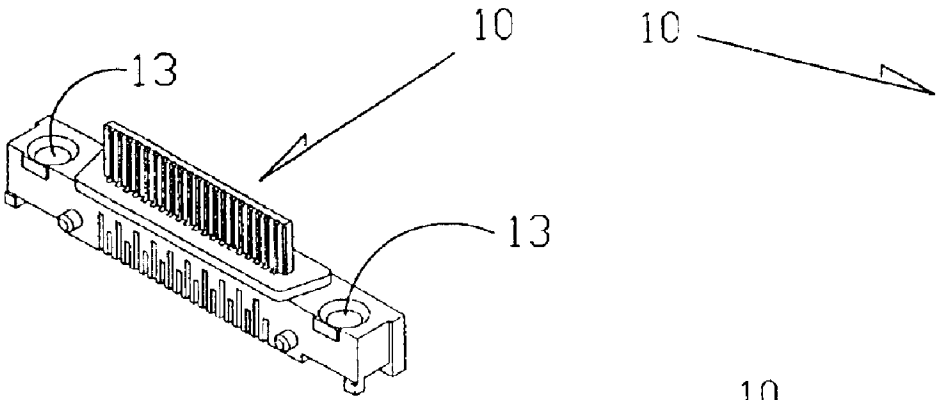
Figure 1F:
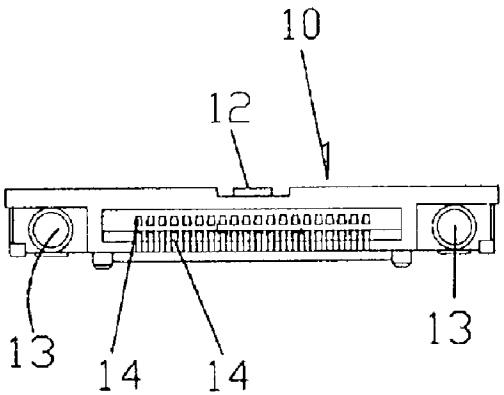
Figure 2:
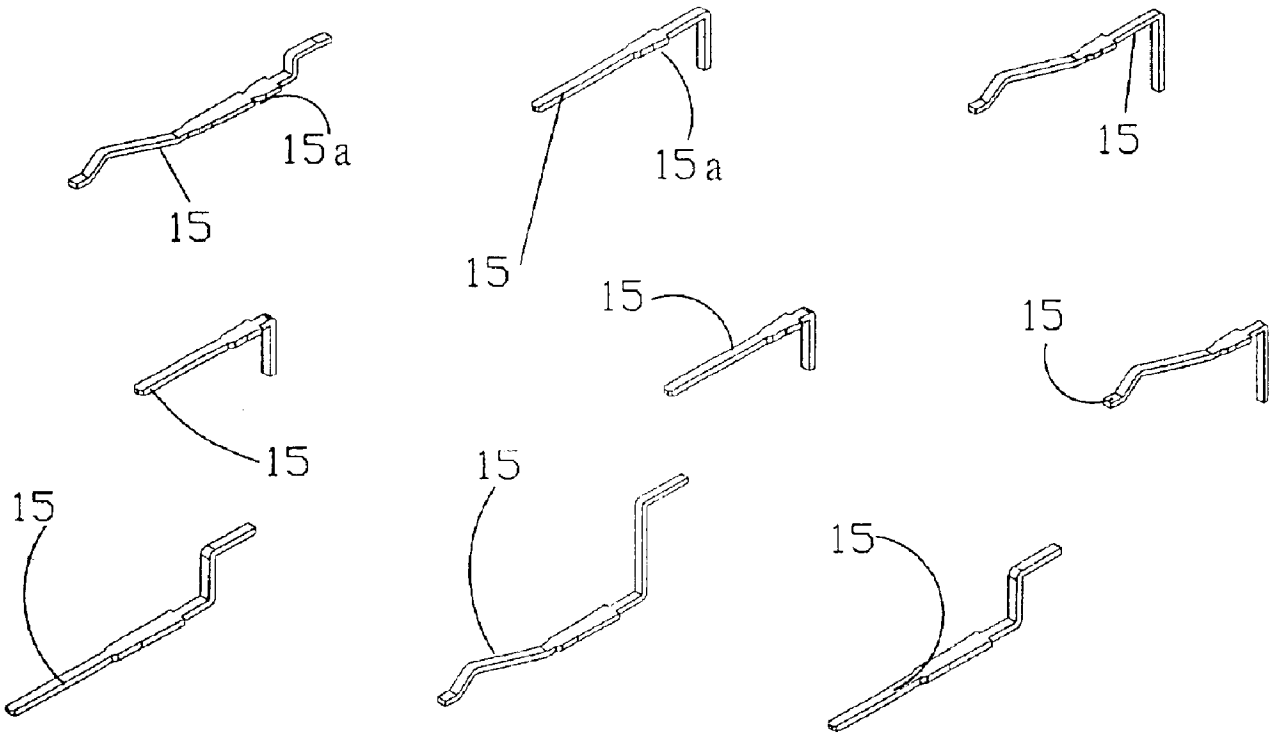
FIG. 2 illustrates different terminals constructed according to the present invention.
Figure 3:
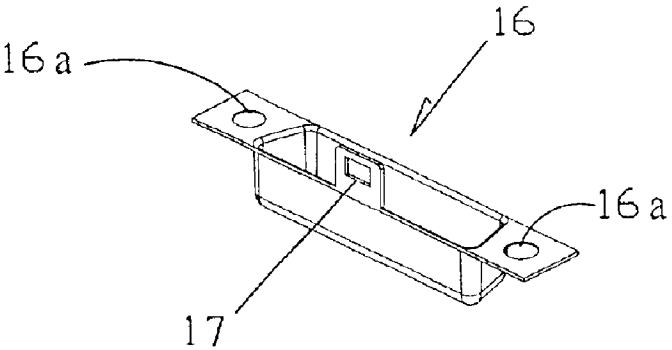
FIG. 3 is an elevational view of a metal shield for the electric connector according to the present invention.
Figure 4A:
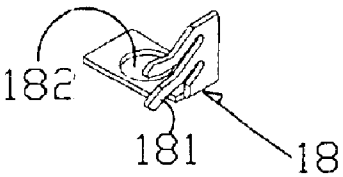
FIG. 4A is an elevational view of a grounding member for the electric connector according to the present invention.
Figure 4B:
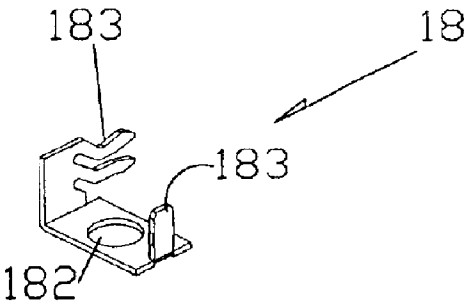
FIG. 4B is an elevational view of an alternate form of the grounding member for the electric connector according to the present invention.
Figure 5A:
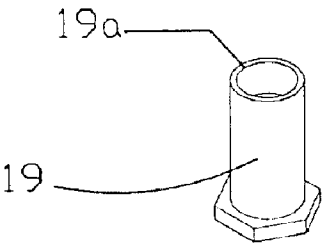
FIG. 5A is an elevational view of a rivet for the electric connector according to the present invention.
Figure 5B:
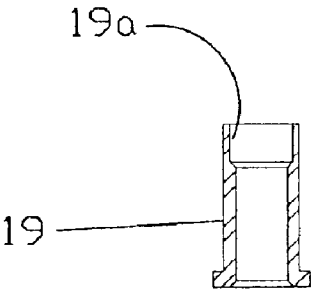
FIG. 5B is a longitudinal view in section of the rivet shown in FIG. 5A.
Figure 6A:
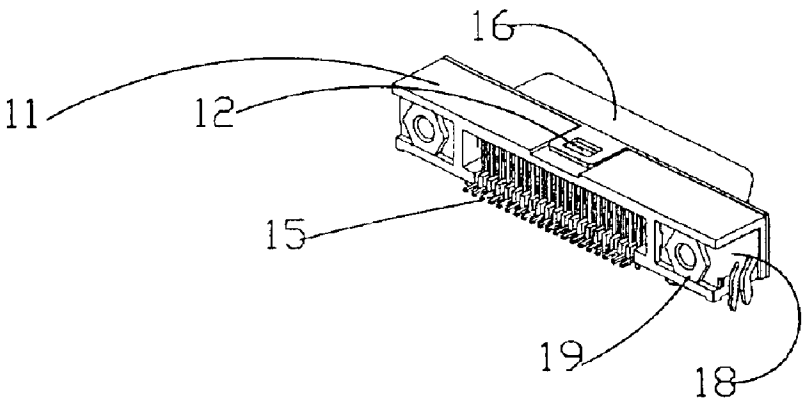
FIG. 6A is an elevational view of the electric connector according to the present invention (only one grounding member installed).
Figure 6B:
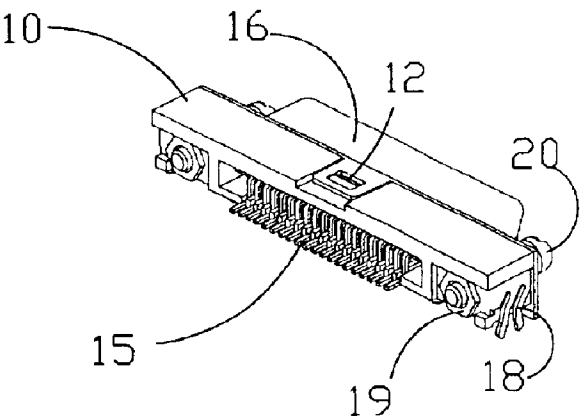
FIG. 6B is similar to FIG. 6A but showing a second grounding member installed.
Figure 7:
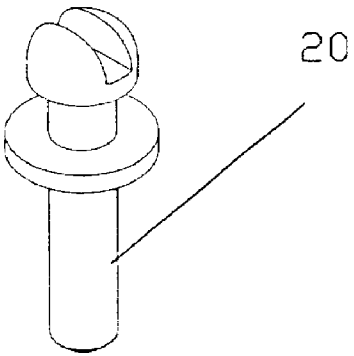
FIG. 7 is an elevational view of a bolt for the electric connector according to the present invention.

The housing 10 or 11 of an electric connector (FIGS. 1A~1F show different forms of electric connector constructed according to the present invention) comprises two parallel rows of terminal slots 14, a hook 12 at a front side, and two mounting holes 13 at two opposite lateral sides. Terminals 15 are respectively mounted in the terminal slots 14, each having a hooked portion 15*a* forced into engagement with the inside wall of the corresponding terminal slot 14 (FIG. 2 shows different forms of terminal adapted to fit the different forms of electric connector shown in FIGS. 1A~1F). A metal shield 16 (see FIG. 3) is provided for fastening to the aforesaid housing 10 or 11 for EMI (electromagnetic interference) protection, having a hook hole 17 for fastening to the hook 12 of the housing 10 or 11, and two mounting holes 16*a* for fastening to the mounting holes 13 of the housing 10 or 11 respectively. Two grounding members 18 are provided and respectively fastened to the housing 10 or 11 at two opposite lateral sides. The grounding member 18 can be made in the form of a substantially L-shaped profile having a mounting hole 182 and a mounting rod 181 (see FIG. 4A). Alternatively, the grounding member 18 can be made having a mounting hole 182 and two mounting rods 183 (see FIG. 4B). Two rivets 19 are respectively inserted through the mounting holes 16*a* of the metal shield 16, the mounting hole 182 of each of the grounding members 18 and the mounting holes 13 of the housing 10 or 11, and then the front plain end 19*a* of each rivet 19 is hammered down to fix the housing 10 or 11, the metal shield 16 and the grounding members 18 together (see FIGS. 5A, 5B, 6A, and 6B). The rivets 19 are internally threaded for receiving a respective screw bolt 20 (see FIG. 7).

Figure 8:
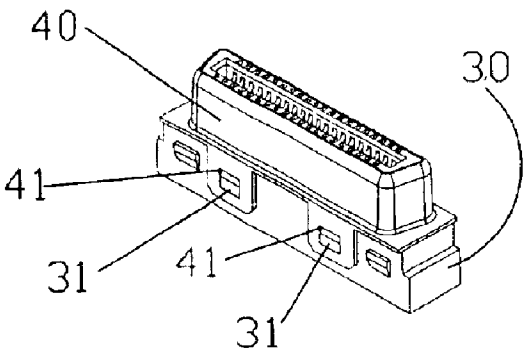
FIG. 8 is an oblique top elevation of an electric connector according to the second embodiment of the present invention.
Figure 9A:
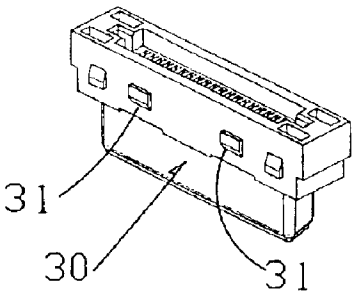
FIG. 9A is an elevational view of the housing for the electric connector according to the second embodiment of the present invention.
Figure 9B:
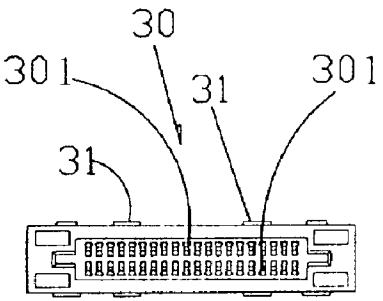
FIG. 9B is a rear side view of the housing for the electric connector according to the present invention.
Figure 10:
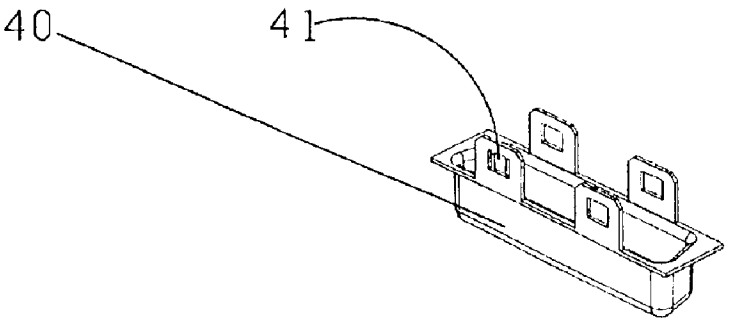
FIG. 10 is an elevational view of the metal shield for the electric connector according to the second embodiment of the present invention.

FIGS. 8 and 9 show a second embodiment of the present invention. According to this embodiment, the housing 30 comprises two parallel rows of terminal slots 301, which receive a respective terminal 15 (see also FIG. 2), and a plurality of hook holes 31, which receive respective hooks 41 of the metal shield 40.

A prototype of electric connector has been constructed with the features of FIGS. 1~10. The electric connector functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An electric connector comprising:

a housing, said housing having two parallel rows of terminal slots and at least one hook, said housing having two first mounting holes symmetrically disposed at two opposite lateral sides thereof;

a plurality of terminals respectively mounted in said terminal slots of said housing, each of said terminals have a hooked portion forced into engagement with an inside wall of a corresponding terminal slot in said housing;

a metal shield mounted outside said housing for Electromagnetic interference protection, said metal shield having at least one hook hole adapted to receive said at least one hook of said housing therein for securing said metal shield thereto, said metal shield having two second mounting holes symmetrically disposed at two opposite lateral sides thereof and respectively disposed in aligned relationship with said two first mounting holes;

a pair of grounding members respectively fastened to said housing and said metal shield for grounding, each of said grounding members being formed with two legs that together form an L-shaped contour of said grounding member, one of said legs having a third mounting hole formed therethrough and disposed in aligned relationship with corresponding first and second mounting holes, each of said legs having mounting rods extending therefrom; and, a pair of internally threaded rivets respectively passing through said first, second and third mounting holes for securing said metal shield to said housing.

* * * * *